US005975718A

United States Patent [19]

White

[11] Patent Number: 5,975,718

[45] Date of Patent: Nov. 2, 1999

[54] HOLIDAY LIGHT SYSTEM

[76] Inventor: James F. White, P.O. Box 6791, New York City, N.Y. 10128

[21] Appl. No.: 08/938,188

[22] Filed: Sep. 25, 1997

[51] Int. Cl.[6] ..... F21P 1/02

[52] U.S. Cl. ..... 362/252; 362/396; 362/806

[58] Field of Search ..... 362/123, 249, 362/252, 396, 806, 234

[56] References Cited

U.S. PATENT DOCUMENTS

| | | | |
|---|---|---|---|
| 4,091,706 | 5/1978 | Ludwig | 362/252 |
| 5,410,458 | 4/1995 | Bell | 362/249 |
| 5,477,437 | 12/1995 | Lach | 362/806 |

*Primary Examiner*—Y. Quach

[57] ABSTRACT

A Christmas light system is provided including a plurality of pieces having a front surface, a rear surface, and a periphery. A plurality of coupling mechanisms are coupled to the periphery of each of the pieces for interconnecting the same. A single clear flexible plastic tube is situated on an associated one of the pieces. A string of wires are situated within the tube having a plurality of bulbs spacedly coupled therealong between a first end and a second end thereof. The first end of the string of at least one piece has a plug mounted thereon for releasably coupling with a power receptacle for receiving power therefrom and delivering the same to the bulbs. The string of each of the pieces has a second end with an interconnect plug coupled thereto for releasably coupling with that of another one of the pieces for providing electrical communication therebetween.

17 Claims, 2 Drawing Sheets

HOLIDAY LIGHT SYSTEM

BACKGROUND OF THE INVENTION

1. Field of the Invention

The present invention relates to Christmas tree lights and more particularly pertains to a new holiday light system for wrapping shrubs and the like with lights.

2. Description of the Prior Art

The use of Christmas tree lights is known in the prior art. More specifically, Christmas tree lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art Christmas tree lights include U.S. Pat. No. 5,213,519; U.S. Pat. No. 5,057,976; U.S. Pat. No. 5,424,925; U.S. Pat. No. 5,213,407; U.S. Pat. No. 4,870,547; and U.S. Pat. Des. No. 358,673.

In these respects, the holiday light system according to the present invention substantially departs from the conventional concepts and designs of the prior art, and in so doing provides an apparatus primarily developed for the purpose of wrapping shrubs and the like with lights.

SUMMARY OF THE INVENTION

In view of the foregoing disadvantages inherent in the known types of Christmas tree lights now present in the prior art, the present invention provides a new holiday light system construction wherein the same can be utilized for wrapping shrubs and the like with lights.

The general purpose of the present invention, which will be described subsequently in greater detail, is to provide a new holiday light system apparatus and method which has many of the advantages of the Christmas tree lights mentioned heretofore and many novel features that result in a new holiday light system which is not anticipated, rendered obvious, suggested, or even implied by any of the prior art Christmas tree lights, either alone or in any combination thereof.

To attain this, the present invention generally comprises a plurality of cloth pieces each constructed from transparent colored fabric. Each cloth piece has a front surface, a rear surface, and a periphery. Such periphery is defined by a pair of linear beveled side edges, an actuate top edge, and an arcuate bottom edge. It should be noted that upon the meeting of the side edges, each cloth piece has a frustoconical configuration. As shown in FIG. 3, a plurality of spaced clips are coupled to one of the side edges of each cloth piece. Each clip includes a first member having a first end coupled to the cloth piece and a second end with a triangular tab integrally coupled thereto and extending therefrom. A second member of each clip has a first end integrally coupled to the first end of the first member and a second end in abutment with the triangular tab of the first member. The clips are constructed from a resilient plastic such that the second ends of the first and second members are adapted to releasably coupled with another beveled side edge of a cloth piece. As best shown in FIG. 2, a single clear flexible plastic tube is coupled to the front surface of an associated one of the cloth pieces. The tube forms a plurality of arcuate generally horizontally oriented spaced rows. Each row is in parallel relationship with the top and bottom edges of the corresponding cloth piece. As such, the tube has a serpentine configuration. Finally, a string of wires are included each with a plurality of bulbs spacedly coupled therealong in parallel between a first end and a second end thereof. In use, the bulbs are adapted to illuminate upon the receipt of power. The first end of each string with a plug is situated at the bottom edge of at least one of the cloth pieces adjacent to one of the side edges thereof. A plug is mounted to the first end of the string for releasably coupling with a power receptacle to receive power therefrom and deliver the same to the bulbs. The string of each of the cloth pieces has a second end with an interconnect plug coupled thereto for releasably coupling with that of another one of the cloth pieces for providing electrical communication therebetween.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new holiday light system apparatus and method which has many of the advantages of the Christmas tree lights mentioned heretofore and many novel features that result in a new holiday light system which is not anticipated, rendered obvious, suggested, or even implied by any of the prior art Christmas tree lights, either alone or in any combination thereof.

It is another object of the present invention to provide a new holiday light system which may be easily and efficiently manufactured and marketed.

It is a further object of the present invention to provide a new holiday light system which is of a durable and reliable construction.

An even further object of the present invention is to provide a new holiday light system which is susceptible of a low cost of manufacture with regard to both materials and labor, and which accordingly is then susceptible of low prices of sale to the consuming public, thereby making such holiday light system economically available to the buying public.

Still yet another object of the present invention is to provide a new holiday light system which provides in the apparatuses and methods of the prior art some of the advantages thereof, while simultaneously overcoming some of the disadvantages normally associated therewith.

Still another object of the present invention is to provide a new holiday light system for wrapping shrubs and the like with lights.

Even still another object of the present invention is to provide a new holiday light system that includes a plurality of pieces having a front surface, a rear surface, and a periphery. A plurality of coupling mechanisms are coupled to the periphery of each of the pieces for interconnecting the same. A single clear flexible plastic tube is situated on an associated one of the pieces. A string of wires are situated within the tube having a plurality of bulbs spacedly coupled therealong between a first end and a second end thereof. The first end of the string of at least one piece has a plug mounted thereon for releasably coupling with a power receptacle for receiving power therefrom and delivering the same to the bulbs. The string of each of the pieces has a second end with an interconnect plug coupled thereto for releasably coupling with that of another one of the pieces for providing electrical communication therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
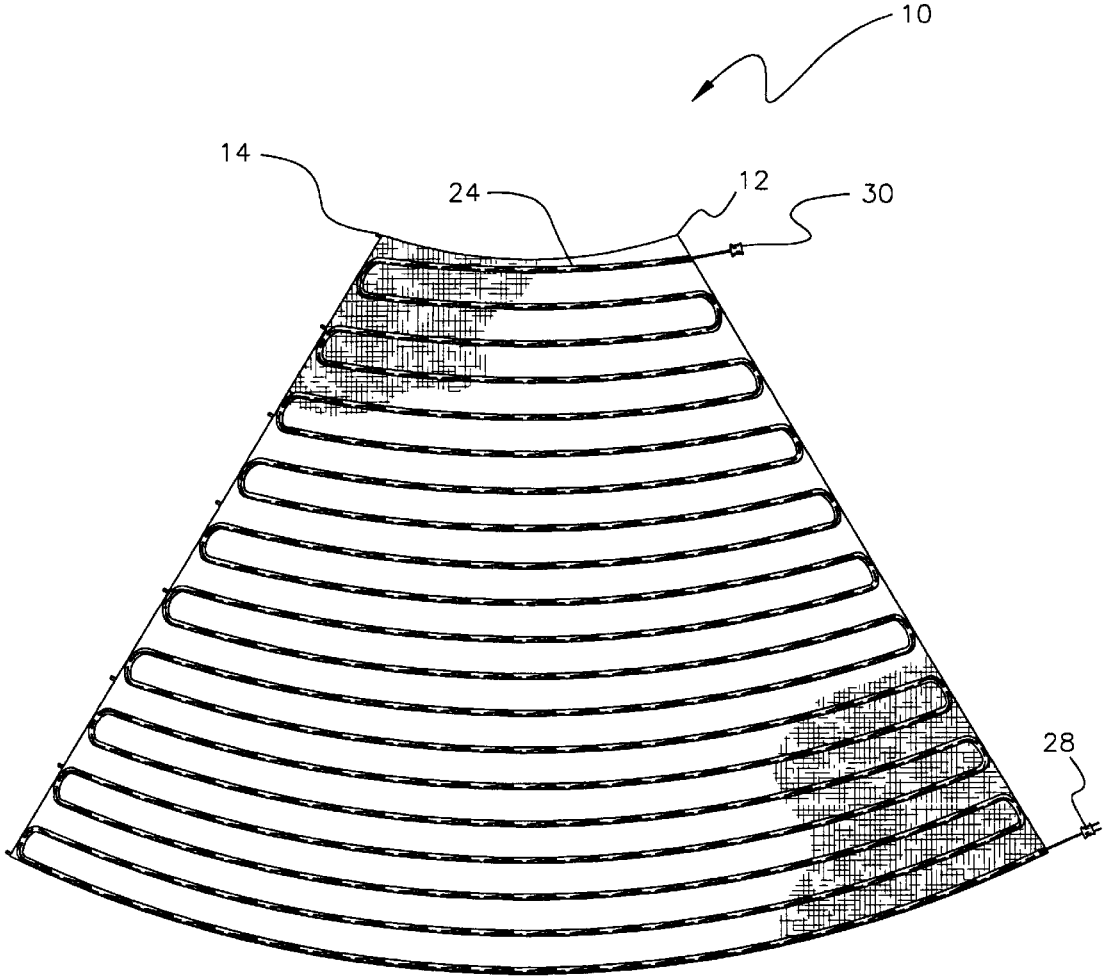
FIG. 1 is a front view of a new holiday light system according to the present invention.
Figure 2:
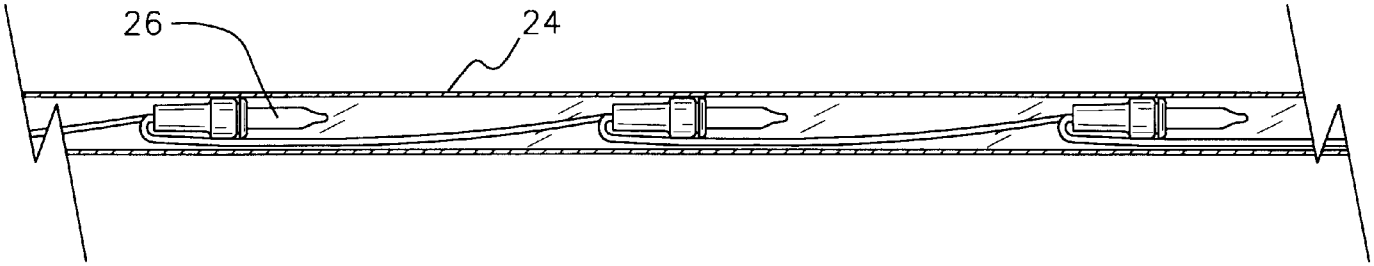
FIG. 2 is a side view of the present invention.
Figure 3:
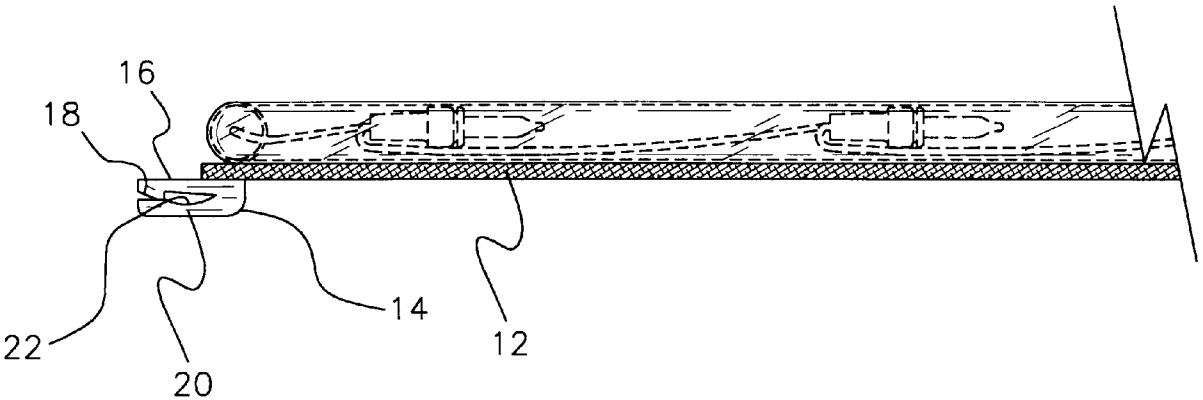
FIG. 3 is a side view of the present invention depicting the one of the clips.

With reference now to the drawings, and in particular to FIGS. 1 through 3 thereof, a new holiday light system embodying the principles and concepts of the present invention and generally designated by the reference numeral 10 will be described.

The present invention, as designated as numeral 10 includes a plurality of cloth pieces 12 each constructed from transparent colored fabric formed of cotton, polyester, or the like. Each cloth piece has a front surface, a rear surface, and a periphery. Such periphery is defined by a pair of linear beveled side edges, an actuate top edge, and an arcuate bottom edge. It should be noted that upon the meeting of the side edges, each cloth piece has a frusto-conical configuration.

As shown in FIG. 3, a plurality of spaced clips 14 are coupled to one of the side edges of each cloth piece. Each clip includes a first member 16 having a first end coupled to the cloth piece and a second end with a triangular tab 18 integrally coupled thereto and extending therefrom. A second member 20 of each clip has a first end integrally coupled to the first end of the first member and a second end in abutment with the triangular tab of the first member. FIG. 3 shows that an interior edge 22 of the second member is arcuate in form. It should be understood that the members of the clips reside in a single plane. The clips are constructed from a resilient plastic such that the second ends of the first and second members are adapted to be biased out of abutment thereby being releasably coupled with a beveled side edge of another cloth piece or the beveled side edge of the cloth piece to which it is attached.

As best shown in FIG. 2, a single clear flexible plastic tube 24 is coupled to the front surface of an associated one of the cloth pieces. The tube forms a plurality of arcuate generally horizontally oriented spaced rows. Each row is in parallel relationship with the top and bottom edges of the corresponding cloth piece. As such, the tube has a serpentine configuration.

Finally, a string of wires are included each with a plurality of bulbs 26 spacedly coupled therealong in parallel between a first end and a second end thereof. In use, the bulbs are adapted to illuminate upon the receipt of power. The first end of each string with a plug is situated at the bottom edge of at least one of the cloth pieces adjacent to one of the side edges thereof. The plug 28 is mounted to the first end of the string for releasably coupling with a power receptacle to receive power therefrom and deliver the same to the bulbs. In the alternative, battery power may be employed.

The string of each of the cloth pieces has a second end with an interconnect plug 30 coupled thereto for releasably coupling with that of another one of the cloth pieces for providing electrical communication between the strings of the cloth pieces. It should be noted that the cloth pieces can be categorized into two categories, the male and female categories. The male cloth pieces have a male plug extending from a first beveled side thereof and the female cloth pieces have a female plug extending from a second beveled side thereof. By this feature, the plugs of the cloth pieces of different categories may be interconnected both physically and electrically.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Christmas light system comprising, in combination:

a plurality of cloth pieces each constructed from transparent colored fabric, each cloth piece having a front surface, a rear surface, and a periphery defined by a pair of linear beveled side edges, an arcuate top edge, and an arcuate bottom edge, whereby upon one of the side edges meeting the other of the side edges, each of the cloth pieces has a frusto-conical configuration;

a plurality of spaced clips coupled to said one of the side edges of each cloth piece, each clip including a first member having a first end coupled to one of the cloth pieces and a second end with a triangular tab integrally coupled thereto and extending therefrom and a second member having a first end integrally coupled to the first end of the first member and a second end in abutment with the triangular tab of the first member, whereby the clips are constructed from a resilient plastic such that the second ends of the first and second members are adapted to releasably coupled with another beveled side edge of a cloth piece;

a single clear flexible plastic tube coupled to the front surface of an associated one of the cloth pieces, forming a serpentine configuration with a plurality of arcuate generally horizontally oriented spaced rows which are in parallel relationship with the top and bottom edges of the corresponding cloth piece, and a string of wires having a plurality of bulbs spacedly coupled therealong in parallel between a first end and a second end thereof, the bulbs adapted to illuminate upon the receipt of power, the first end of the string situated at the bottom edge of at least one of the cloth pieces adjacent to one of the side edges thereof and having a plug mounted thereon for releasably coupling with a power receptacle for receiving power therefrom and delivering the power to the bulbs, the string of each of the cloth pieces having a second end with an interconnect plug coupled thereto for releasably coupling with another plug of another one of the cloth pieces for providing electrical communication therebetween.

2. A Christmas light system comprising:

a plurality of cloth pieces, each of the pieces having a front surface, a rear surface, and a periphery;

a plurality of coupling means coupled to the periphery of each of the pieces for interconnecting the pieces;

a clear plastic tube situated on an associated one of the pieces; and a string of wires having a plurality of bulbs spacedly coupled therealong between a first end and a second end thereof, the bulbs adapted to illuminate upon the receipt of power, the first end of the string of at least one piece having a plug mounted thereon for releasably coupling with a power receptacle for receiving power therefrom and delivering the power to the bulbs, the string of each of the pieces having a second end with an interconnect plug coupled thereto for releasably coupling with another plug of another one of the pieces for providing electrical communication therebetween, wherein the string is situated within an associated one of the plastic tubes;

wherein each piece is defined by a pair of linear beveled side edges, an actuate top edge, and an arcuate bottom edge, whereby upon placement of the side edges in an abutting condition, each cloth piece has a frusto-conical configuration.

3. A Christmas light system as set forth in claim 2 wherein the clear plastic tube has a serpentine configuration.

4. A Christmas light system as set forth in claim 2 wherein the clear plastic tube has a plurality of arcuate generally horizontally oriented spaced rows.

5. A Christmas light system as set forth in claim 2 wherein the bulbs are connected in parallel.

6. A Christmas light system as set forth in claim 2 wherein the pieces are each constructed from transparent fabric.

7. A Christmas light system as set forth in claim 2 wherein the pieces are each constructed from colored fabric.

8. A Christmas light system as set forth in claim 2 wherein each coupling means is a clip including a first member having a first end coupled to the piece and a second end with a triangular tab integrally coupled thereto and extending therefrom and a second member having a first end integrally coupled to the first end of the first member and a second end in abutment with the triangular tab of the first member, whereby the clips are constructed from a resilient plastic such that the second ends of the first and second members are adapted to releasably coupled with another beveled side edge of a piece.

9. A Christmas light system as set forth in claim 2 wherein each coupling means is a clip.

10. A Christmas light system comprising:

a plurality of pieces, each of the pieces having a front surface, a rear surface, and a periphery;

a plurality of coupling means coupled to the periphery of each of the pieces for interconnecting the pieces;

a clear plastic tube situated on an associated one of the pieces; and a string of wires having a plurality of bulbs spacedly coupled therealong between a first end and a second end thereof, the bulbs adapted to illuminate upon the receipt of power, the first end of the string of at least one piece having a plug mounted thereon for releasably coupling with a power receptacle for receiving power therefrom and delivering the power to the bulbs, the string of each of the pieces having a second end with an interconnect plug coupled thereto for releasably coupling with another plug of another one of the pieces for providing electrical communication therebetween, wherein the string is situated within an associated one of the plastic tubes;

wherein each of the coupling means comprises a clip.

11. A Christmas light system as set forth in claim 10 wherein the clear plastic tube has a serpentine configuration.

12. A Christmas light system as set forth in claim 10 wherein the clear plastic tube has a plurality of arcuate generally horizontally oriented spaced rows.

13. A Christmas light system as set forth in claim 10 wherein the bulbs are connected in parallel.

14. A Christmas light system as set forth in claim 10 wherein the pieces are each constructed from transparent fabric.

15. A Christmas light system as set forth in claim 10 wherein the pieces are each constructed from colored fabric.

16. A Christmas light system as set forth in claim 10 wherein each piece is defined by a pair of linear beveled side edges, an actuate top edge, and an arcuate bottom edge, whereby upon placement of the side edges in an abutting condition, each cloth piece has a frusto-conical configuration.

17. A Christmas light system as set forth in claim 10 wherein each of the clips includes a first member having a first end coupled to the piece and a second end with a triangular tab integrally coupled thereto and extending therefrom and a second member having a first end integrally coupled to the first end of the first member and a second end in abutment with the triangular tab of the first member, whereby the clips arc constructed from a resilient plastic such that the second ends of the first and second members are adapted to releasably coupled with another beveled side edge of a piece.

* * * * *